US010201843B2

(12) United States Patent
Avrillaud

(10) Patent No.: US 10,201,843 B2
(45) Date of Patent: Feb. 12, 2019

(54) METHOD, TOOL AND PRESS FOR THE ELECTROHYDRAULIC FORMING OF A WORKPIECE

(71) Applicant: ADM28 S.ar.l., Luxembourg (LU)

(72) Inventor: Gilles Avrillaud, Pinsaguel (FR)

(73) Assignee: ADM28 S.ÀR.L., Luxembourg (LU)

( * ) Notice: Subject to any disclaimer, the term of this patent is extended or adjusted under 35 U.S.C. 154(b) by 870 days.

(21) Appl. No.: 14/760,346

(22) PCT Filed: Jan. 9, 2014

(86) PCT No.: PCT/EP2014/050318
§ 371 (c)(1),
(2) Date: Jul. 10, 2015

(87) PCT Pub. No.: WO2014/108468
PCT Pub. Date: Jul. 17, 2014

(65) Prior Publication Data

US 2015/0360275 A1 Dec. 17, 2015

(30) Foreign Application Priority Data

Jan. 11, 2013 (FR) ..... 13 50270

(51) Int. Cl.
*B21D 26/02* (2011.01)
*B21D 26/12* (2006.01)
(Continued)

(52) U.S. Cl.
CPC ..... *B21D 26/12* (2013.01); *B21D 22/02* (2013.01); *B21D 22/10* (2013.01); *B21D 22/22* (2013.01); *B21D 22/30* (2013.01); *B21D 26/06* (2013.01)

(58) Field of Classification Search
CPC ..... B21D 26/12; B21D 26/02; B21D 22/205; B21D 22/06; B21D 22/10; B21D 22/22; B21D 22/30
(Continued)

(56) References Cited

U.S. PATENT DOCUMENTS 6,519,992 B1 * 2/2003 Schnupp ..... B21D 22/205 29/421.1
7,150,170 B2 * 12/2006 Streubel ..... B21D 26/02 72/57
(Continued)

FOREIGN PATENT DOCUMENTS

EP 2 292 343 A1 3/2011

OTHER PUBLICATIONS

International Search Report, dated Jun. 17, 2014, from corresponding PCT application.

*Primary Examiner* — David B Jones
(74) *Attorney, Agent, or Firm* — Young & Thompson

(57) ABSTRACT

A method for forming a workpiece by stamping that allows spring back to be eliminated, wherein tooling (20) is used, at least one of the forming parts (21, 23) of which includes a cavity (26) filled with a liquid (27) and provided with electrodes (28) capable of generating at least one shock wave in the cavity and through the wall (25) of the forming part, a blank material (18) is deformed between the two forming parts under the action of a deformation pressure and, without releasing the deformation pressure, at least one shock wave is generated in the cavity so that the shock wave passes through the blank material orthogonal to its surface. The tooling (20) and a press (10) adapted to implement the method are also described.

16 Claims, 2 Drawing Sheets

(51) Int. Cl.

| | |
|---|---|
| ***B21D 26/06*** | (2006.01) |
| ***B21D 22/02*** | (2006.01) |
| ***B21D 22/10*** | (2006.01) |
| ***B21D 22/22*** | (2006.01) |
| ***B21D 22/30*** | (2006.01) |

(58) Field of Classification Search
USPC ..... 72/56
See application file for complete search history.

(56) References Cited

U.S. PATENT DOCUMENTS

| | | | | |
|---|---|---|---|---|
| 8,966,950 | B2 * | 3/2015 | Golovashchenko ... | B21D 26/12 29/421.1 |
| 2009/0272167 | A1 | 11/2009 | Golovashchenko | |
| 2009/0272168 | A1 | 11/2009 | Golovashchenko et al. | |
| 2011/0056262 | A1 | 3/2011 | Thewes | |
| 2012/0103045 | A1 | 5/2012 | Golovashchenko | |

* cited by examiner

METHOD, TOOL AND PRESS FOR THE ELECTROHYDRAULIC FORMING OF A WORKPIECE

BACKGROUND OF THE INVENTION

Field of the Invention

The invention relates to a method for forming a workpiece, particularly a workpiece from sheet metal, by applying plastic deformation to a blank material, having reduced spring back. The invention further relates to tooling and to a press used in this method.

Description of the Related Art

One of the methods most commonly used for forming workpieces from sheet metal, such as workpieces for motor vehicle bodywork, is stamping, which involves stressing a flat sheet metal blank between two forming parts (usually a punch and a die) each having an outer shape that is substantially identical, except for the sheet metal thickness, to the desired shape of the workpiece to be obtained. Several passes can be required in order to obtain the final shape of the workpiece in order to distribute the deformations and to avoid tearing the sheet. The stress that is applied to the sheet metal blank has to exceed the elastic limit of the material that is used so as to cause permanent plastic deformation thereof. However, when the applied stress is released, the fraction of this stress that is absorbed by elastic deformation of the workpiece causes spring back, particularly in the bending zones thereof, substantially changing the dimensional characteristics obtained before unloading. In order to compensate for this spring back, the shape of the punch and of the die can be modified in order to take into account the spring back. Nevertheless, setting up a forming tool that takes into account this spring back is complicated. Furthermore, for each variation in material (causing a variation in the elastic limit thereof), the compensation of the spring back is not perfect, which causes dimensional differences from one workpiece to the next. For this reason, a plurality of stamping steps is normally provided with sets of punches and dies with increasing degrees of spring back compensation.

A method for forming a workpiece is known from the document US 2009/0272167, which method comprises a first step of forming and a second step of shaping allowing a workpiece to be obtained that complies with the expected dimensions. In this method, the workpiece is initially formed by electrohydraulic forming or by conventional stamping, and is then mounted on a shaping tool comprising a punch against which the workpiece is powerfully forced by a pressure developed by an electric arc in the vessel of an electrohydraulic forming tool. Such a method is particularly costly and difficult to implement. Indeed, it requires new machines and new tooling and has disadvantages that are associated with the use of a liquid, in particular water, in the electrohydraulic forming method, namely sealing problems around the blank material, risks of corrosion of the formed workpiece, etc. Furthermore, the method is not optimal as it involves removing the workpiece in order for it to be repositioned in new tooling after the first forming step.

BRIEF SUMMARY OF THE INVENTION

Therefore, the object of the present invention is to provide a method for forming a workpiece without spring back that does not have the disadvantages of the prior art. In particular, the object of the invention is to provide such a method, at reduced cost, that can be adapted on conventional stamping presses.

A further object of the invention is to provide a method for forming that allows the advantages of forming by stamping and of electrohydraulic forming to be combined and to reduce, even eliminate, the spring back phenomena and the internal stresses generated by a conventional stamping press.

A further object of the invention is to provide a method for forming in a single operation, without handling the workpiece between the various steps of the method.

A further object of the invention is forming tooling adapted to implement the method as claimed in the invention. In particular, the object of the invention is forming tooling that can be mounted on a conventional stamping press and that only requires minor modifications to the working environment.

Finally, the object of the invention is a stamping press adapted to receive the forming tooling and to implement the method for forming as claimed in the invention.

To this end, the invention relates to a method for forming a workpiece by plastic deformation, wherein:

a) a press is used that is provided with tooling comprising a first forming part and a second forming part, each forming part comprising a face opposite the other part, having an outer shape that complements the shape of a workpiece to be obtained;

b) a blank material is inserted between the first and the second forming part;

c) the press is activated so as to exert a pressure, named deformation pressure, capable of deforming the blank material between the first and the second forming part, wherein at least one of the forming parts of the tooling that is used comprises a cavity filled with a liquid and provided with means capable of generating at least one shock wave in the cavity and through a wall of said forming part, said wall being adapted to be substantially non-deforming under the deformation pressure and to have an elastic limit that is higher than a stress generated by the shock wave in the wall, and wherein:

d) the deformation pressure is maintained between the forming parts after the deformation of the blank material;

e) at least one shock wave is generated in the cavity so that the shock wave passes through the blank material substantially orthogonal to its surface;

f) the deformation pressure on the blank material is released and the blank material is ejected.

Throughout the present description, the terms shock wave or pressure wave are used interchangeably, given that the pressure gradient of the pressure wave is high enough to be comparable to a shock wave.

In this method, a sequence of operations is used that is similar to the sequence of operations of conventional stamping, with tooling (a punch, die pair) that does not require size modifications to be carried out in order to compensate for spring back. By maintaining pressure on the workpiece in the tooling and by generating a shock wave in one of the parts of the tooling, the punch or the die, this shock wave or pressure wave that is generated in the cavity of the tooling passes through the wall of the tooling and is applied to the blank forming material in a direction that is mainly orthogonal to its surface, i.e. along its thickness. By selecting the energy for generating the pressure wave so that the stress generated by the propagation of this wave through the materials through which it passes is lower than the elastic limit of the tooling material, in order to avoid damaging said tooling, and is higher than the elastic limit of the material of the blank material to be formed, the pressure wave generates a stress in the blank material that is mainly orthogonal to its surface, in the plastic range, which reduces the longitudinal stresses parallel to the surface that are caused by the deformation of the blank material in the tooling. This reduction of the longitudinal stresses is realised so as to compensate for the longitudinal spring back. Nevertheless, potential spring back can occur towards the thickness of the workpiece and only causes very slight deformations thereof when the tooling is opened. For this reason, subsequent stamping and/or shaping operations no longer need to be provided, which eliminates additional operations compared to a conventional stamping method. Furthermore, the shaped workpiece no longer needs to be reworked in a subsequent shaping operation, since shaping the workpiece to its nominal dimensions is carried out in the same operation as its initial deformation. Therefore, the method as claimed in the invention is particularly economical compared to the known methods.

Advantageously and as claimed in the invention, the shock wave is generated by means of an electric arc that is triggered between two electrodes that penetrate the cavity. By creating a high-power electric arc between the two electrodes, the quasi-instantaneous vaporisation of the liquid over the path of the electric arc triggers a shock wave (i.e. a pressure wave with a very high pressure gradient) inside the cavity. This pressure wave moves away from the electric arc in all directions until it encounters the inner face of the wall of the cavity. It is transmitted through this wall up to the blank material. Thus, the conventional stamping method is associated with a method derived from electrodynamic forming, with the difference being that the shock wave does not force the blank material into contact with the liquid against a punch, but is transmitted by the tooling.

Advantageously and as claimed in the invention, the electric arc is obtained by a current pulse with between 10 kJ and 100 kJ of energy. This energy is generated by storing an electric current in a battery of high-voltage capacitors (between 2 kV and 300 kV, and preferably between 20 kV and 50 kV) and the rapid discharging thereof, for example by means of a spark gap, to the terminals of the electrodes.

Advantageously and as claimed in the invention, a plurality of shock waves, preferably between two and four shock waves, is sequentially generated without releasing the deformation pressure. It has been noted that, depending on the material, its flatness and its deformation, the blank material could not be in even contact with the forming parts, despite maintaining the deformation pressure. Applying a series of shock waves thus allows the points of partial contact to be eliminated between the blank material and the tooling and allows a more homogenous orthogonal stress to be obtained on the surface of the blank material.

The invention further relates to forming tooling adapted to implement the method for forming a workpiece by plastic deformation, comprising a first forming part and a second forming part, each forming part comprising a face opposite the other part having an outer shape that complements the shape to be obtained on the workpiece, wherein at least one of the forming parts comprises a cavity filled with a liquid and provided with means capable of generating at least one shock wave in the cavity and through a wall of said forming part, said wall being adapted to be substantially non-deforming under a deformation pressure that is applied between the forming parts and to have an elastic limit higher than a stress generated by the shock wave. Thus, by providing a cavity filled with liquid, for example water, inside one of the parts of the forming tooling, a shock wave can be generated in the tooling, which shock wave is transmitted to the blank material without said blank material necessarily being in contact with the liquid. Preferably, the cavity is closed, for example by a plug, but also could be open on a relatively weak part of its surface, without necessarily modifying its function.

Advantageously and as claimed in the invention, the means for generating a shock wave comprise at least one electrode that penetrates the cavity and is connected to a high pulsed power generator adapted to provide a current pulse with between 10 kJ and 100 kJ of energy. In order to generate the shock wave, for example by vaporising the liquid by means of an electric arc, only one electrode needs to penetrate the cavity, the second electrode being realised by the wall of the forming tooling itself.

Advantageously and as claimed in the invention, the tooling comprises at least one pair of electrodes passing through the wall of the cavity through feedthrough insulators. Even though a single electrode can be used, it is nevertheless preferable for two electrodes to be used that are isolated from the wall of the forming tooling in order to be able to adjust the inter-electrode distance and to avoid having to pass an electric current into the wall of the forming tooling in order to minimise the risks of electro-corrosion. Furthermore, depending on the size of the tooling, it can be worthwhile arranging a plurality of pairs of electrodes so as to generate a plurality of shock waves at the same time from points distributed in the tooling, in order to even out the pressure wave over the entire surface of the part.

Advantageously and as claimed in the invention, the electrodes of at least one pair of electrodes are connected by a metal wire adapted to be vaporised when the current pulse is applied. Such a filament, or explodable wire, vaporises and forms a plasma when a high intensity current passes through it, which plasma in turn generates a large amount of gas that causes a shock wave. By using a plurality of pairs of electrodes, each provided with an explodable wire, a plurality of shock waves can be successively generated without needing to replace the explodable wire of the first pair of electrodes.

Advantageously and as claimed in the invention, the forming part comprising the cavity comprises means for replacing the liquid inside said cavity. Repeating the electric discharges that cause the shock waves, particularly in series production, can pollute the liquid in the cavity. It is then worthwhile providing the tooling part comprising the cavity with means for replacing this liquid, by providing a water supply pipe and a drainage pipe, for example, both of which are provided with a stop valve, or are even under permanent pressure, which means are adapted to allow continuous replacement, or replacement at regular intervals, of the liquid contained in the cavity.

The invention further relates to a stamping press provided with tooling with at least one of the aforementioned features. Thus, a "conventional" stamping press can be used with tooling as claimed in the invention by adding a suitable electric pulse generator and a device capable of circulating water in the cavity of the tooling to this press. Consequently, the equipment in an existing stamping shop can be used at reduced cost and without requiring a major modification to the equipment.

The invention further relates to a method for forming, to forming tooling, and to a stamping press characterised in combination by all or part of the features mentioned above or hereafter.

BRIEF DESCRIPTION OF THE DRAWINGS

Further objects, features and advantages of the invention will become apparent upon reading the following description and with reference to the appended stampings, wherein.

DETAILED DESCRIPTION OF THE PREFERRED EMBODIMENTS

Figure 1:
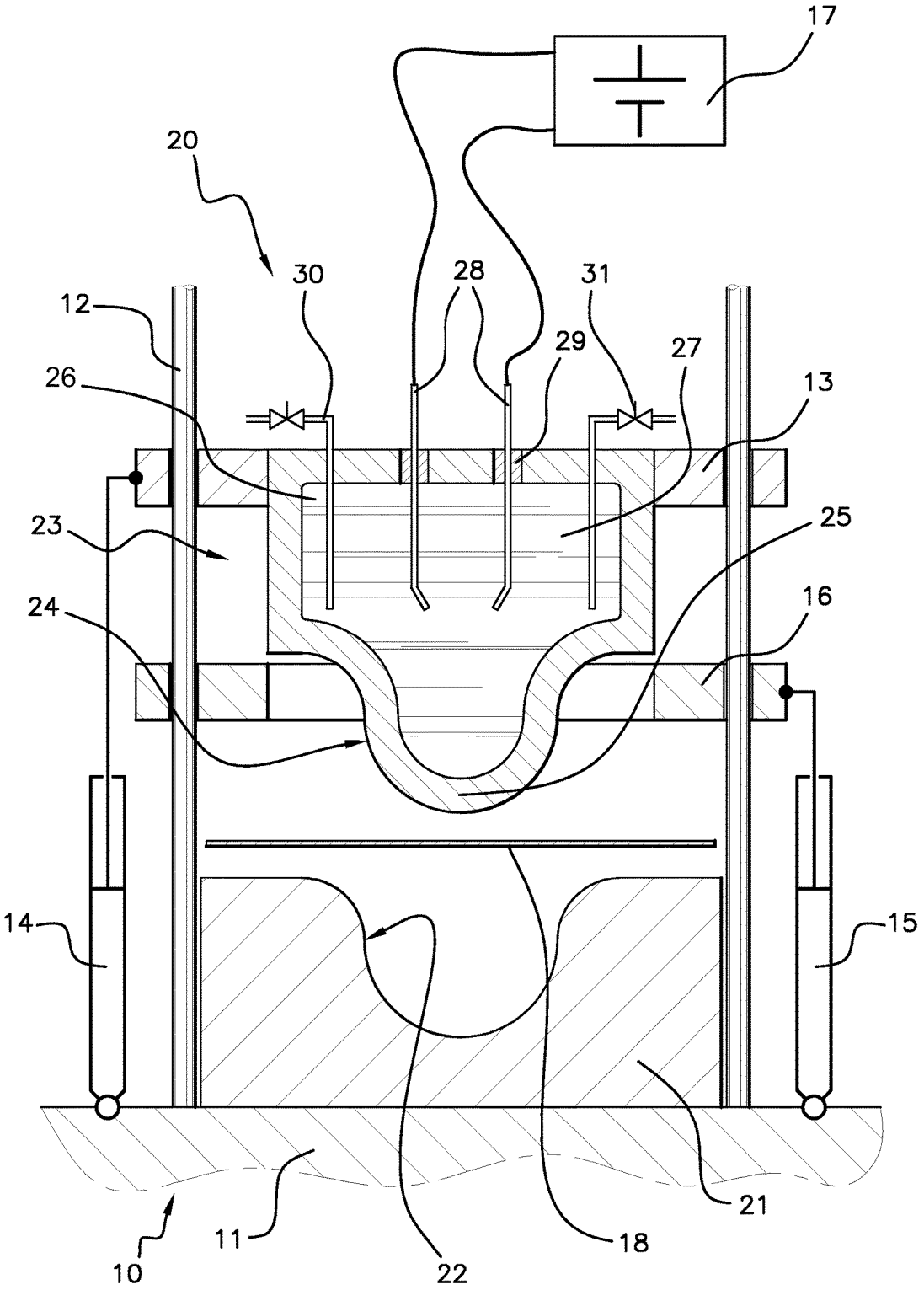
FIG. 1 is a schematic section view of tooling as claimed in the invention mounted on a suitable press.

The press 10, which is shown in FIG. 1 in the form of a column press, comprises a bed 11, on which guide columns 12 allow the tooling to be guided, for example a tooling holder 13 adapted to slide along the columns 12 under the force of a main cylinder 14 or even a blank holder 16 sliding under the action of a secondary cylinder 15. The tooling 20 is formed by a first forming part or die 21 fixed to the bed 11 and a second forming part or punch 23 fixed to the tooling holder 13. The die 21 and the punch 23 have respective surfaces 22 and 24, the shape of which is complementary so as to be able to deform a blank material 18, for example a plate of sheet metal, made of steel or aluminium.

In the example shown in FIG. 1, the punch 23 comprises a cavity 26 filled with liquid 27. The liquid 27 is generally water, preferably non-distilled, so as to have non-zero conductivity. The cavity 26 is delimited, at least opposite the die 21, by a thick wall 25, the outer surface 24 of which defines, by cooperating with the surface 22 of the die 21, the shape of the part to be obtained. The thickness of the wall 25 is determined as a function of the punch material and of the deformation forces needed to form the blank material.

Preferably, the punch 23 and the die 21 are made of tempered alloy steel, with an elastic limit of approximately 500 to 1,500 MPa.

Two electrodes 28 penetrate inside the cavity 26 through feedthrough insulators 29 and are immersed in the liquid 27. The two electrodes 28 are connected to a high pulsed power current generator 17 comprising a plurality of high-voltage capacitors adapted to store between 10 kJ and 100 kJ of energy and a means for rapidly discharging these capacitors, for example a spark gap, to the terminals of the electrodes. When the generator 17 is discharged between the two electrodes 28, a high-power electric arc is established between the two electrodes and instantaneously vaporises the liquid 27 in the vicinity of the electric arc, which allows a pressure wave to be generated that has a very high pressure gradient, i.e. a shock wave, on the electric arc, and which radially propagates in all directions.

Of course, other configurations of electrodes are possible such as, for example, the use of a single electrode penetrating the cavity through a sealed feedthrough, the second electrode being formed by the punch itself, connected to ground. It is also possible for a coaxial cable to be used, part of which is bare, the ground braid and the cable core then forming two electrodes. Furthermore, in the case of large tooling, which is designed to draw large workpieces, it can be worthwhile installing a plurality of pairs of electrodes at different points of the cavity and coupling them either in series or in parallel to the same, suitably powered generator 17, or to a plurality of generators synchronously controlled so as to generate a plurality of shock waves at the same time in order to produce a resulting pressure wave that evenly covers the entire surface 24 in contact with the blank material 18.

The means for generating a shock wave can further comprise a metal filament connected between the two electrodes 28. When discharging the generator 17, the filament, also named explodable wire, vaporises, generating a very high temperature metal plasma. This plasma in turn causes its surrounding water to be vaporised and thus generates a shock wave. The tooling can further comprise a plurality of pairs of electrodes, at least some of which are connected by explodable wires so as to be able to generate a plurality of successive shock waves without having to work on the tooling to replace the explodable wire destroyed by the first shock wave.

The punch 23 can further comprise supply/drainage pipes 30 for the liquid 27 in the cavity 26 in order to replace the liquid 27. The pipes 30 can be provided with a stop valve 31, even if these stop valves are not absolutely necessary, the liquid in the cavity can be pressurised by a permanent supply or even can be left at atmospheric pressure.

Figure 2:
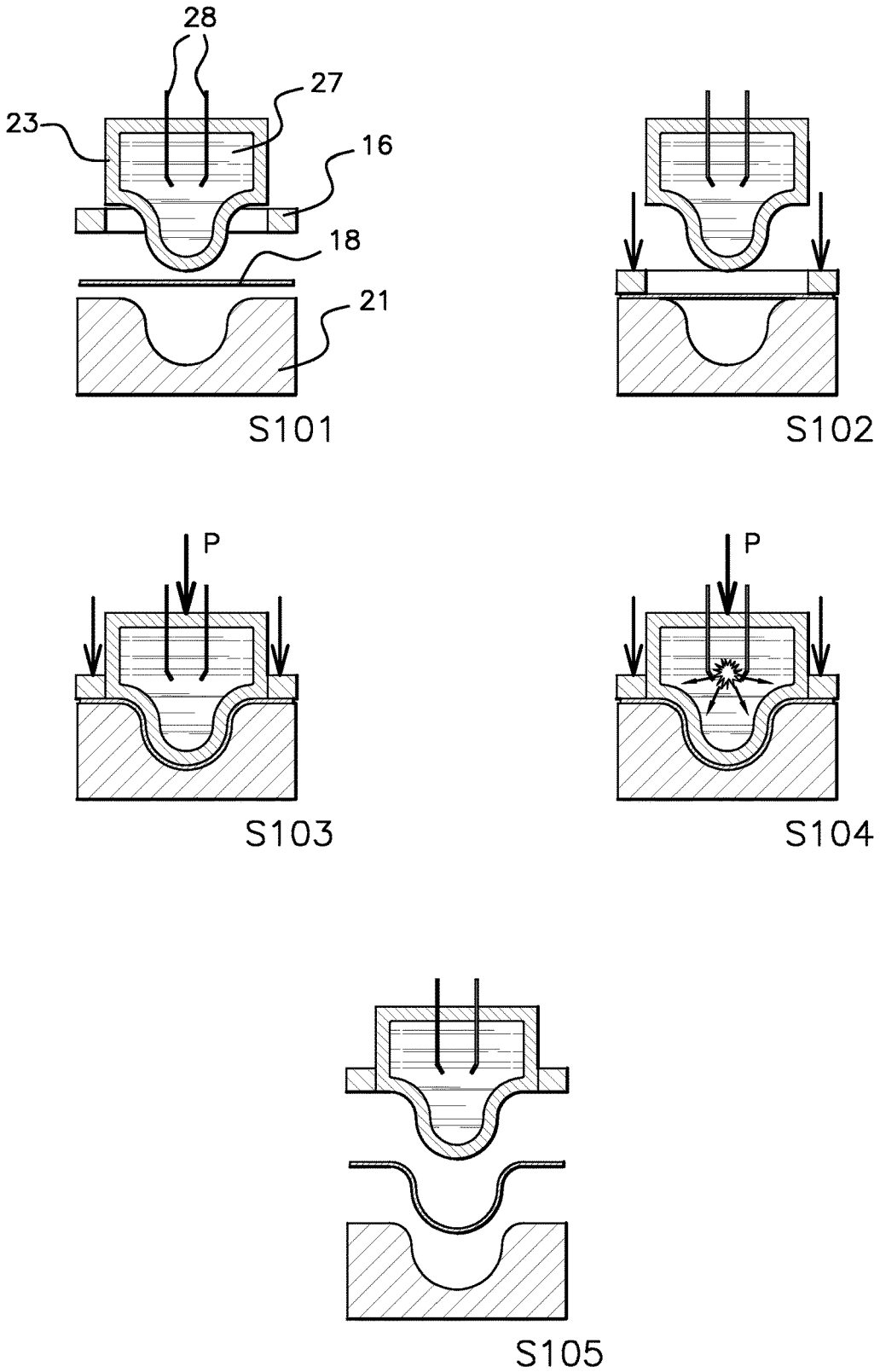
FIG. 2 schematically shows the steps of the method as claimed in the invention.

Reference will now be made to FIG. 2, which shows various steps of the method as claimed in the invention. During the initial step S101, the cylinders of the press 10 are controlled in order to keep the tooling 20 open, i.e. the punch 23 and the blank holder 16 are separated from the die 21. A blank material 18 is then placed on the die 21. During the next step S102, the secondary cylinder 15 of the press is activated in order to close the blank holder 16 towards the die 21 and to maintain and immobilise the blank material 18 between the blank holder and the die.

During the step S103, the main cylinder 14 of the press is activated so as to lower the punch 23 towards the die. Under the action of the deformation pressure P, the blank material 18 is deformed between the punch 23 and the die 21 in order to acquire the desired final shape.

The deformation pressure P is then maintained between the punch 23 and the die 21 and, during the step S104, an electric arc is triggered between the electrodes 28 in order to generate a shock wave, shown by the arrows that radially extend away from the electric arc.

By way of an example, applying approximately 50 kJ of energy between the electrodes 28 generates a dynamic pressure wave with amplitude of approximately 500 MPa, which is distributed in the cavity 26 until it encounters the inner face of the wall 25. This pressure wave, with some losses associated with reflections on the inner face of the wall 25, is communicated in the form of a stress on the wall 25, then on the blank material 18, before being distributed through the die 21 towards the bed 11 of the press. The stress generated in the wall 25 of the punch 23, as in the blank material 18, by this pressure wave is approximately 300 MPa. This stress is lower than the elastic limit of the punch material, which is higher than 700 MPa, and therefore does not cause any plastic deformation of the punch, the shape of which is maintained. However, for a blank material 18 comprising a disc of aluminium alloy, for example, 6061 T4 aluminium, the elastic limit of which is approximately 140 MPa, the 300 MPa stress is much greater than the elastic limit. Plastic compression of the blank material 18 then follows along its thickness. The inventors have thus noted that this compression stress, which is orthogonal to the surface of the blank material, allowed the stresses parallel to this surface to be removed and released, in particular the bending and traction stresses generated by the plastic deformation when forming the blank material.

The step S104 can be repeated several times, without releasing the deformation pressure P. Indeed, the inventors have also noted that when the blank material 18 is deformed during the step S103, spurious deformations, such as low amplitude ripples on the surface of the formed workpiece, could prevent close contact between the punch 23 and the workpiece, thus degrading the transmission of the stress orthogonal to the surface of the workpiece. Applying first shock waves when repeating the step S104 allows the contact between the punch and the workpiece to be improved, by releasing the surface stresses at the points of contact and by flattening these ripples. The next shock waves allow the stress to be transmitted mainly orthogonal to the entire surface of the workpiece.

By way of an example, a blank material 18 made of 6061 T4 aluminium, in the form of a 250 mm diameter disc, is drawn in the shape of a 50 mm deep cone. The spring back is measured on the depth of the cone. In this way, it has been noted that, after "conventional" stamping, i.e. before applying a shock wave to the tooling as claimed in the invention, the spring back is approximately 1.2 mm, that is nearly 2.5%. After applying a first shock wave of approximately 300 MPa, the spring back falls to 1%, then to 0.6% for the second shock wave and, after applying a third shock wave, the spring back is just 0.02%.

It is to be noted that, by virtue of the tooling as claimed in the invention, the step S104 can be repeated relatively quickly, the repetition frequency only being affected by the recharging of the generator 17. Furthermore, it is no longer necessary for the workpiece to be handled between each repetition of the step S104, since the workpiece remains in the tooling 20.

Since repeating the step S104 is likely to pollute the liquid 27, changing this liquid can be scheduled either on completion of a certain number of repetitions or by providing permanent liquid circulation through the pipes 30.

After applying a number of shock waves that corresponds to the desired precision and to the material used for the blank material 18, the step S105 is implemented, in which the cylinders 14 and 15 are activated so as to lift the punch 23 and the blank holder 16. The formed workpiece then can be released, which workpiece has virtually no more spring back.

The press 10 is a conventional hydraulic press, of the column press type in the example that has been described, to which the high pulsed power generator 17 has been added and, where necessary, to which a liquid supply circuit for the liquid 27 has been added. The use of an existing stamping shop is thus possible without involving significant modification to the machines in order to implement the method for forming as claimed in the invention.

Of course, this description is provided by way of an illustrative example only and numerous modifications can be added thereto without departing from the scope of the invention, such as, for example, using all sorts of presses, such as of the swan neck or other type. Furthermore, the part of the forming tooling comprising the cavity 26 is not necessarily the punch 23 but, in a symmetric manner, could be the die 21. The conventional stamping steps can also be carried out by means of one or more conventional punches and the punch 23 comprising the cavity 26 can be used only during the final stamping pass or after this final pass. Nevertheless, the workpiece 18 will need to be stressed again before generating the shock wave.

The invention claimed is:

1. A method for forming a workpiece by plastic deformation, the method comprising:

inserting a blank material between a first forming part and a second forming part of tooling, a press being provided with the tooling, each one of the first and second forming parts respectively comprising a face, opposite another one of the first and second forming parts, having an outer shape that complements a shape of a workpiece to be obtained;

activating said press to exert a deformation pressure that deforms said blank material between said first forming part and said second forming part, at least one of said forming parts of said tooling that is used comprising a wall and a cavity configured to be filled with a liquid and provided with a shock wave generator configured to generate at least one shock wave in said cavity and through the wall of said forming part, the at least one shock wave generating a stress in the wall, said wall being configured to be substantially non-deforming under the deformation pressure and to have an elastic limit that is higher than the stress generated by the shock wave in said wall;

maintaining the deformation pressure between said first and second forming parts after the deformation of said blank material;

generating at least one shock wave in said cavity so that the shock wave passes through said blank material substantially orthogonal to its surface; and releasing the deformation pressure on said blank material and ejecting said blank material is.

2. The method as claimed in claim 1, wherein the shock wave is generated by an electric arc triggered between two electrodes penetrating said cavity.

3. The method as claimed in claim 2, wherein a plurality of shock waves is sequentially generated without releasing the deformation pressure.

4. The method as claimed in claim 2, wherein the electric arc is obtained by a current pulse with between 10 kJ and 100 kJ of energy.

5. The method as claimed in claim 4, wherein a plurality of shock waves is sequentially generated without releasing the deformation pressure.

6. The method as claimed in claim 1, wherein a plurality of shock waves is sequentially generated without releasing the deformation pressure.

7. The method as claimed in claim 6, wherein the plurality of shock waves sequentially generated is between two and four shock waves.

8. A tooling configured to form a workpiece by plastic deformation, the tooling comprising:

a first forming part and a second forming part, each one of the first and second forming parts comprising a face, opposite another one of the first and second forming parts, having an outer shape that complements a shape to be obtained on said workpiece, at least one of said forming parts comprising a wall and a cavity configured to be filled with a liquid and provided with a shock wave generator configured to generate at least one shock wave in said cavity and through the wall of said forming part, the at least one shock wave generating a stress in the wall, said wall being configured to be substantially non-deforming under a deformation pressure applied between said first and second forming parts when the deformation pressure is applied between the first and second forming parts and to have an elastic limit higher than the stress generated by the shock wave.

9. The tooling as claimed in claim 8, wherein said shock wave generator comprises at least one electrode penetrating said cavity and connected to a high pulsed power generator configured to provide a current pulse with between 10 kJ and 100 kJ of energy.

10. The tooling as claimed in claim 9, wherein said forming part that comprises said cavity comprises a liquid replacement system configured to replace said liquid inside said cavity.

11. The tooling as claimed in claim 9, further comprising at least one pair of electrodes passing through said wall of said cavity through feedthrough insulators.

12. The tooling as claimed in claim 11, wherein said forming part that comprises said cavity comprises a liquid replacement system configured to replace said liquid inside said cavity.

13. The tooling as claimed in claim 11, wherein said electrodes of at least one pair of electrodes are connected by a metal wire configured to be vaporized when the current pulse is applied.

14. The tooling as claimed in claim 13, wherein said forming part that comprises said cavity comprises a liquid replacement system configured to replace said liquid inside said cavity.

15. The tooling as claimed in claim 8, wherein said forming part that comprises said cavity comprises a liquid replacement system configured to replace said liquid inside said cavity.

16. A stamping press, comprising:

the tooling as claimed in claim 8.

* * * * *